United States Patent [19]

Gallo

[11] 3,990,199

[45] *Nov. 9, 1976

[54] CRYPT FRONT REMOVABLE MOUNTING MEANS AND METHOD

[76] Inventor: Roberto A. Gallo, 2468 Wiley St., Hollywood, Fla. 33020

[ * ] Notice: The portion of the term of this patent subsequent to Sept. 16, 1992, has been disclaimed.

[22] Filed: Jan. 19, 1976

[21] Appl. No.: 650,491

[52] U.S. Cl. ..... 52/137; 52/126; 52/139; 52/235; 52/509; 52/704; 52/747

[51] Int. Cl.[2] ..... E04B 1/40; E04C 1/00

[58] Field of Search ..... 52/133, 378, 134, 379, 52/137, 509, 136, 698, 138, 702, 139, 704, 365, 126, 366, 747, 235

[56] References Cited

UNITED STATES PATENTS

| | | | |
|---|---|---|---|
| 2,302,920 | 11/1942 | Sobie | 52/509 X |
| 2,574,938 | 11/1951 | Sinner et al. | 52/378 |
| 2,618,145 | 11/1952 | Sinner et al. | 52/136 X |
| 2,860,504 | 11/1958 | Sinner et al. | 52/509 X |
| 3,181,664 | 5/1965 | Aagaard | 52/509 X |
| 3,213,576 | 10/1965 | Davies | 52/139 X |
| 3,342,005 | 9/1967 | Rickards et al. | 52/509 X |
| 3,778,942 | 12/1973 | Bondi | 52/509 X |
| 3,905,169 | 9/1975 | Gallo | 52/137 |

*Primary Examiner*—Price C. Faw, Jr.
*Assistant Examiner*—Leslie Braun
*Attorney, Agent, or Firm*—Erwin M. Barnett

[57] ABSTRACT

Backing plates, each having a relatively large centrally disposed through opening, are positioned in mortar in a predetermined vertical plane to provide flat coplanar surfaces for receiving support brackets for crypt fronts thereagainst. Each bracket has spaced horizontal slots through which expansion bolts extend and pass through said backing plate opening which properly positions the bolts to avoid cracking the concrete of the crypt partition. The horizontal slots provide adjustability for accommodating differences in dimensions between the compartmented crypt structure and the fronts. Means is also provided in the bracket to accommodate differences in thickness between adjacent fronts to insure vertical alignment of the forward facing surfaces thereof.

8 Claims, 9 Drawing Figures

CRYPT FRONT REMOVABLE MOUNTING MEANS AND METHOD

BACKGROUND OF THE INVENTION

1. Field of the Invention

The invention relates generally to burial vaults having a plurality of open front compartments providing crypts arranged in horizontal rows and vertical tiers, and is directed to a method of construction and means for removably fastening a face plate or front of marble or the like material to each crypt in a coplanar relation, each front serving to conceal one, or, in the case of husband and wife, two adjacent compartments, and being individually removable and replaceable, and cooperating with adjacent fronts to provide a decorative vertical wall structure. 2. Description of the Prior Art The method and construction disclosed in my prior U.S. Pat. No. 3,905,169, granted Sept. 16, 1975, requires determination of the location on the backing plate of holes for the anchor bolts for the bracket and then the drilling of such holes through the backing plate. The location and configuration of the preformed openings in the bracket, because of irregularity and spacing of the crypt partition walls which do not conform exactly to the dimensions of the fronts, have been found often to require locating the anchor bolts excessively close to the surface of such partitions causing the concrete of the latter to crack when the anchor bolts are expanded. Also, the brackets lack means for accommodating fronts of varying thicknesses, being designed for only those fronts in which the corners have been precut to a uniform predetermined thickness.

SUMMARY OF THE INVENTION

Among the objects of the invention is to improve the method and construction of that disclosed in my said U.S. Pat. No. 3,905,169 by eliminating the drilling of the holes in the backing plate and the likelihood of cracking the concrete of the partitions because of the undesirable necessity of locating the anchor bolts excessively close to the surface of the partitions, and also to provide for accommodating fronts having varying thicknesses, that is, those without precut corners.

The invention utilizes the combination of brackets having flat rear surfaces secured, by anchor bolts, in abutment on backing plates which are premounted in vertical coplanar relation on the open front end of a compartmented crypt structure. Each backing plate has a preformed elongated central opening adapted for mounting in medial alignment with the central vertical axis of a vertical partition of the crypt structure to define a limited area through which expansion anchoring bolts for the bracket may extend without cracking the concrete. As an aid for retaining the backing plates in position on a layer of mortar or cement, integrally formed tabs may be depressed from the backing plate front surface to extend rearwardly and downwardly at an acute angle to the plane thereof. The forward facing side of each of the brackets includes a forwardly extending boss having an internally threaded bore for removably receiving an anchoring screw of a rosette, a horizontal ledge extending laterally from the bore for supporting the bottom edges of adjacent marble fronts, a rib extending vertically from the bore serving as a lateral stop against which a side edge of the front abuts, and a shoulder formed with adjustable means for engaging a rear of the marble front to locate the outfacing surface against said rosette in a predetermined vertical plane. Each bracket has preformed spaced horizontal slots located in the upper portion thereof for receiving the anchor bolts therethrough to provide maximum horizontal adjustability.

The method of initial installation of the vertical wall of marble fronts comprises the steps of mounting the backing plates on a layer of mortar or cement applied to the concrete crypt structure to lie in coplanar relation with each other and with the central opening of each plate in medial alignment with the central vertical axis of the respective vertical partition; locating the bracket on its backing plate and determining a point of registration in each horizontal slot with the central opening of the underlying backing plate as the marble fronts are installed tier by tier; drilling holes through the backing plate opening into the concrete vertical partition at said determined points; securing the bracket in its location with anchoring bolts inserted through the slots, central opening and into the drilled holes; and adjusting the screws in the shoulders of the brackets to accommodate differences in thicknesses of the marble fronts to bring the forward facing surfaces thereof in vertical alignment prior to attachment of the rosettes.

DESCRIPTION OF THE PREFERRED EMBODIMENTS

Figure 1:
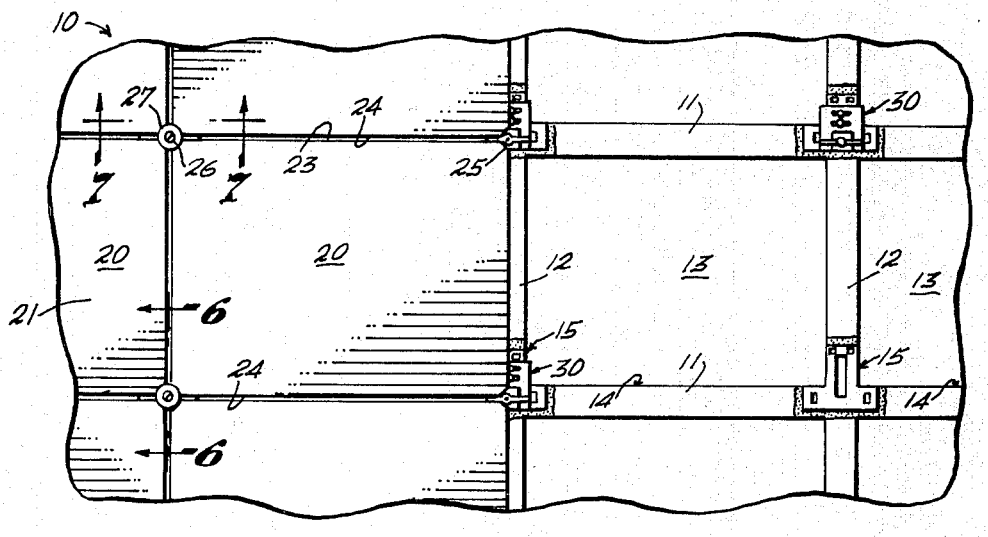
FIG. 1 is a fragmentary front elevational view of a compartmented crypt structure illustrating an installation of fronts or closure panels for the crypts as a vertical wall, the fronts on the right being removed to show the underlying mounting means.
Figure 2:
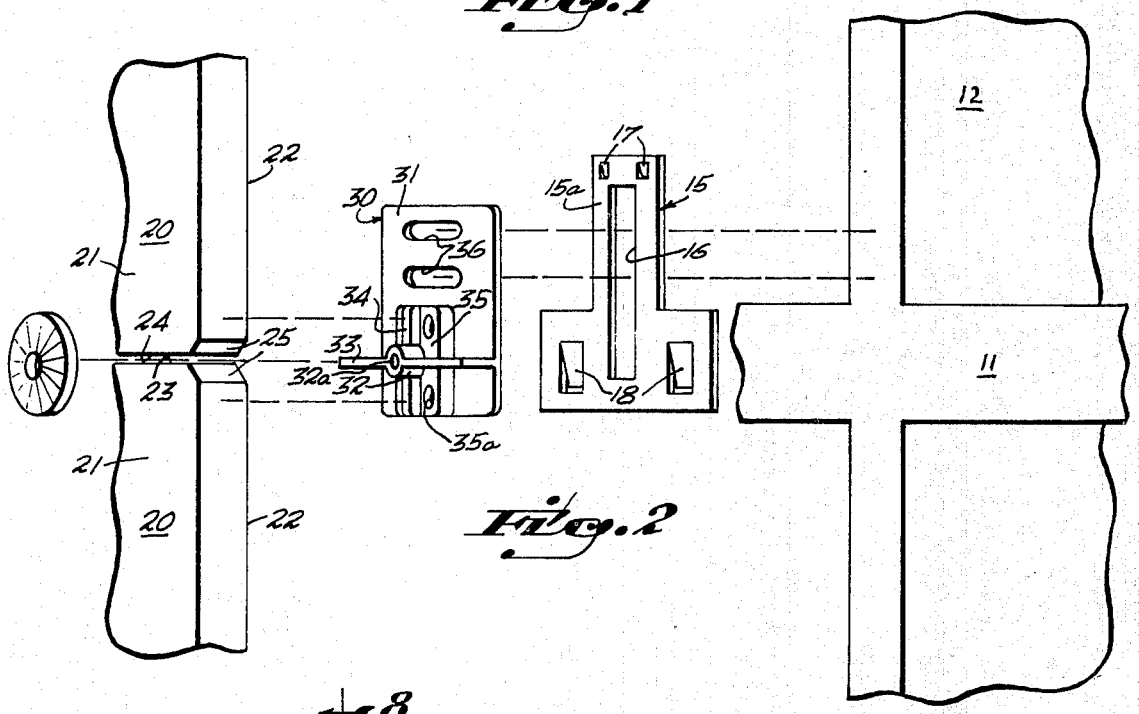
FIG. 2 is an enlarged fragmentary exploded perspective view of the crypt structure, backing plate, bracket, fronts and rosette shown in FIG. 1.
Figure 3:
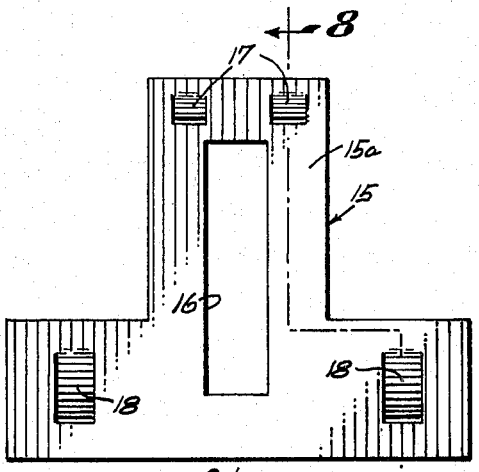
FIG. 3 is an enlarged front elevation view of the backing plate.
Figure 4:
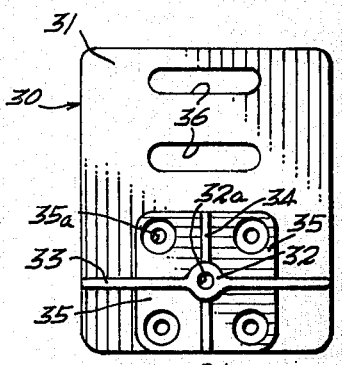
FIG. 4 is an enlarged front elevation view of the bracket.

Referring in detail to the drawings, 10 generally denotes a mausoleum structure sectionalized by horizontal and vertical partitions 11 and 12 into vertically disposed horizontal tiers of crypts 13 having open front ends 14, each for receiving a casket (not shown) into the respective crypt. As seen in FIG. 1, an overall decorative vertical front wall for the mausoleum is composed of individually and removably mounted closure panels or fronts 20. A double size front for closing a pair of adjacent husband and wife crypts may also be used as shown and described in my said prior patent. Each front 20, made of marble, simulated marble or other like material, has a flat and polished outfacing surface 21, a rear surface 22 which may be slightly irregular, and bottom and top edges 24 and 23, repectively, which terminate at opposite ends in chamfered corners 25.

Fronts 20 are mounted at their four corners on brackets 30 which in turn are mounted against backing plates 15. A feature of the invention is the simple structure and arrangement of backing plates 15 which are set in layers of mortar or cement C against the concrete of the crypt structure with their front surfaces 15*a* all lying in a predetermined vertical plane x—x and each having a central rectangular through-opening 16 extending symmetrically along the vertical midline thereof which is substantially aligned with the vertical midline of a vertical partition 12 to serve as a guide for properly positioning expansion anchor bolts 19 for brackets 30. Each backing plate 15 may be stamped or otherwise formed from sheet metal in a generally T-shape for use in an inverted position at the intersection of crypt horizontal and vertical partitions 11 and 12, as is clear from FIGS. 2, 3, 5 and 8. Suitable means, such as integrally formed pairs of spaced apart rearwardly bent and downwardly extending upper and lower tabs 17 and 18, are provided for retaining backing plates 15 in position on the wet mortar or cement C until the latter sets.

Brackets 30 are shown in FIGS. 2, 4, 5, 6 and 7 to each have a rectangular shaped plate-like base 31 formed with a flat rear surface and a boss 32 projecting outwardly at right angles to the plane of the rear surface and having an internally threaded bore 32*a* for receiving a center screw 26 of a rosette 27. Boss 32 is located at the lower quarter of the bracket as a hub from which horizontal ledge 33, vertical rib 34 and four quarter shoulders 35 radiate. Each shoulder 35 has its midportion formed with an internally threaded bore 35*a* for adjustably receiving an aligning screw 37. The upper portion of base 31 beyond rib 34 and shoulders 35 is formed with spaced apart horizontally extending slots 36 for the purpose hereinafter described.

In accordance with the invention, there is no requirement for presetting of anchors or other special handling prior to the pouring and curing of the concrete of the horizontal and vertical partitions 11 and 12. After removal of the forms from the set concrete and in order to eliminate irregularities in the mounting surface thereof, backing plates 15 are applied on layers of mortar or cement C to the open front ends 14 of crypts 13 at the intersections of horizontal and vertical partitions 11 and 12, and with the aid of well known masonary practices the front surfaces 15*a* are brought into accurate vertical coplanar alignment with each other in a predetermined plane x—x. Each backing plate 15 is positioned within said plane x—x so that the horizontal portion thereof is in registered alignment with the horizontal partition 11 and the rectangular through-opening 16 exends upwardly and is centralized with respect to the midline of the vertical partition 12, as is clear from FIG. 5.

After cement C sets, completing the initial steps of the method of installation, the positions of the bottom tier of brackets 30 on their respective backing plates 15 are each precisely determined for receiving the bottom edges 24 of the lowermost tier of fronts 20 on ledges 33 thereof. Anchor bolt holes are then drilled in each vertical partition 12 in the area defined by through-opening 16 to register with slots 36, and anchor bolts

Figure 5:
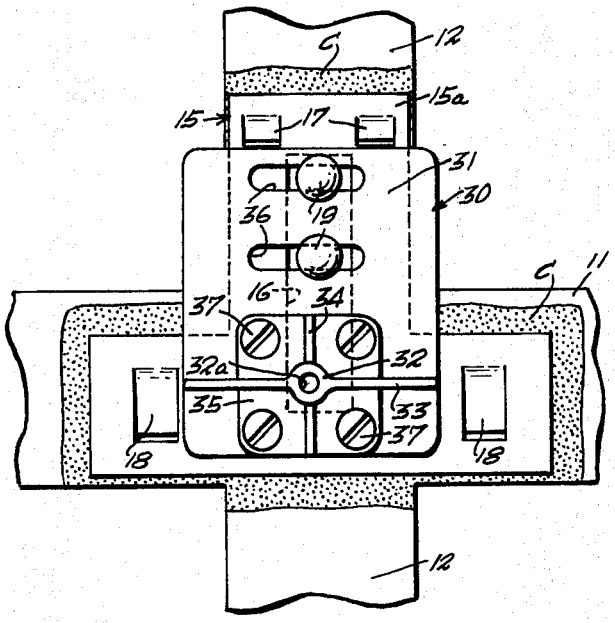
FIG. 5 is an enlarged fragmentary front elevational view of the backing plate and bracket mounted on the crypt structure at a partition intersection.
Figure 6:
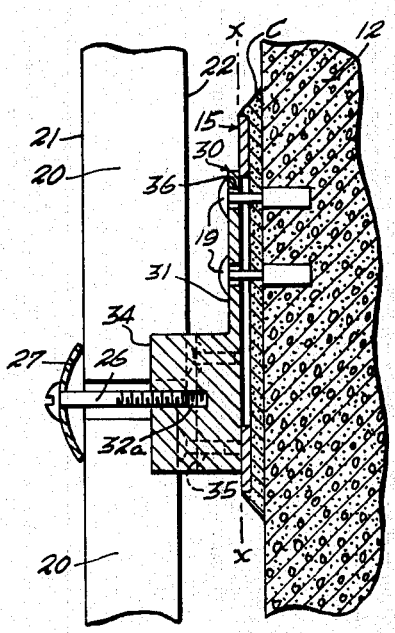
FIG. 6 is an enlarged fragmentary sectional view taken on line 6—6 in FIG. 1.
Figure 7:
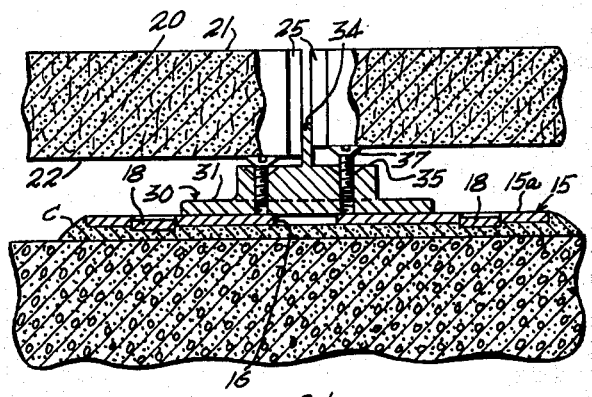
FIG. 7 is an enlarged fragmentary sectional view taken on line 7—7 in FIG. 1 showing the adjustable means for aligning the forward facing surfaces of the fronts.

19 inserted through slots 36 and through-opening 16 into the drilled holes and expanded to firmly attach each bracket 30 against its backing plate 15. Now, as fronts 20 are placed in succession on ledges 33 of the mounted tier of brackets 30, the second tier of brackets 30 are installed on the corners of top edges 23 by slipping the lower portion of the bracket 30 behind the respective installed front 20. An accurate positioning of each bracket 30 is facilitated when the fit is made between two adjacent fronts. The proper hole locations are determined in the area of through-opening 16 to register at a point along each slot 36. Holes may then be drilled by a bit extending through each slot 36 while the bracket 30 is held in the determined position on the backing plate 15 and then secured by bolts 19. Rosettes 27 are attached for retaining the fronts in place against shoulders 35 by threading screws 26 into bores 32*a* as installation progresses. Slots 36 provide horizontal adjustability in mounting brackets 30 where the spacing between the vertical partitions 12 is slightly irregular as compared to the uniform length of the fronts 20 requiring bracket 30 to be positioned slightly off center with respect to backing plate 15, as illustrated in FIG. 5.

Where adjacent fronts 20 differ in thickness at the corner areas which abut shoulders 35, aligning screws 37 are threaded out from the respective bore 35*a* and adjusted to bring outfacing surfaces 21 into proper vertical alignment as shown in FIGS. 6 and 7. Where the corners of all fronts 20 are cut to a uniform thickness, aligning screws 37 may be omitted or removed from bores 35*a*.

The entire vertical wall is installed tier by tier following the procedure of progressively fitting brackets 30 along upper edges and corners of fronts as they are positioned on the previously mounted brackets in preparation for the next tier. Double size fronts (not shown) for husband and wife may be interspersed with single fronts 20, and trim strips (not shown) installed to conceal the brackets along the bottom, side and top borders of the wall in the well understood manner.

Figure 9:
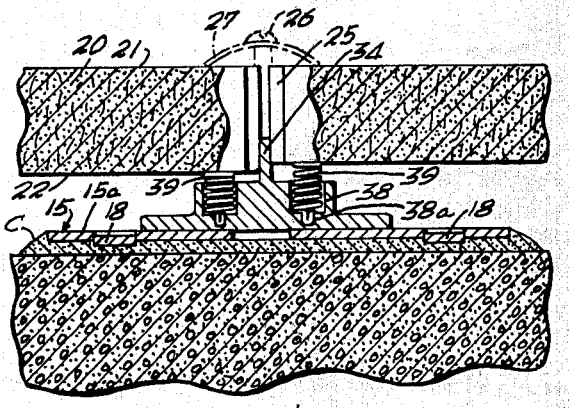
FIG. 9 is a fragmentary sectional view similar to FIG. 7 but showing a modified means for aligning the facing surfaces of the fronts as a self-adjusting coiled spring.
Figure 8:
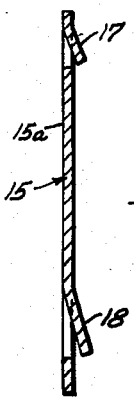
FIG. 8 is a sectional view taken on line 8—8 in FIG. 3.

A modified form of bracket 30 is shown in FIG. 9 in which a compression spring 39 projects from and is fully compressible into a bore 38 formed in shoulder 33 replacing aligning screw 37 and threaded bore 35*a*, spring 39 engaging the rear side of front 20 and urging the latter outwardly against rosette 27 to maintain all fronts 20 in vertical alignment. Suitable means is provided for attaching spring 39 to bracket 30, such as a bent inner end of spring 39 being press fitted into an inner reduced size bore 38*a*. In practice, use of compression springs 39 at the lower corners of fronts 20, because of the heavy weight and friction thereof on ledges 33, has been found to give relatively poor results as compared to the positive action of screws 37. However, use of screws 37 at the lower corners and springs 39 at the upper corners may render ease in operation and desirable results.

Removal of any individual front 20 for access to the crypt behind is readily accomplished by loosening the center screws 26 of rosettes 27 on the four corners of such front and easing the latter forwardly out of its position on the bracket ledges 33. The structure of the backing plates 15 embedded in the layers of cement C and the abutment fit of brackets 30 against plate front surfaces 15*a* is seen to eliminate all play between the brackets 30 and the concrete structure in an improved manner and, as in my said prior patent, any displacement or shifting of a bracket 30 from its original position due to the weight of front 20 after installation is likewise eliminated thereby facilitating removal and permitting subsequent replacement of fronts 20 by merely easing the latter back in place on ledges 33 and securing the corners by tightening rosette screws 26.

It is to be understood that the bracket 30 herein shown and described for four adjacent corners may be modified for other specific positions in the vertical wall comparable to those shown and described in my said prior patent, namely, as two corner upper and middle of a double size front lower bracket 50, middle upper double size front and two corner lower bracket 60, double size front middle upper and middle lower bracket 70, side bracket 80, and corner bracket 90 as well as the mirror images of the two latter type brackets. It is contemplated that these brackets for specific positions have their plate-like bases all of a uniform size with the upper halves provided with slots 36 and the lower halves having ledges 33, ribs 34, and shoulders 35, fitted with screws 37 or springs 39, appropriately repositioned and modified.

Backing plates 15 may be stamped from a non-corrosive metal, such as, stainless steel, and brackets 30 cast as an integral structure or otherwise fabricated of a non-corrosive metal alloy, such as, gunmetal, bronze or the like.

The mountings for individually removable fronts of a vertical wall of a mausoleum structure and the method of installing same is seen to achieve the several objects of the invention and to be well adapted to meet conditions of practical use. As various possible embodiments might be made in the disclosed construction and method, it is to be understood that all matter herein set forth and shown in the accompanying drawings are to be interpreted as illustrative and not in a limiting sense.

What is claimed is:

1. Mountings for individually removable fronts of a vertical wall of a mausoleum structure compartmented by vertical and horizontal concrete partitions into rows and vertical tiers of individual crypts, each of said mountings comprising a backing plate having a centralized enlarged through-opening and being embedded in a layer of cement applied to said structure at an intersection of said partitions and having an exposed flat surface aligned in a common predetermined vertical plane with said through-opening centralized with respect to the midline of said vertical partition, a bracket having a plate-like base with a flat rear surface for mounting against said exposed surface of each of said backing plates, said base having means for supporting and positioning corners of said front on a lower portion thereof and spaced horizontally extending elongated slots formed in an upper portion thereof, anchor bolts extending through said slots and backing plate through-opening and into holes drilled in the concrete of the vertical partition in a medial area defined and limited by said through-opening to avoid being so close to the surface of said vertical partition as to cause cracking of the concrete when the bolts are expanded, said elongated slots providing horizontal adjustability of the bracket with respect to the vertical partition to accommodate variations in the spacing between the latter as compared to the length of the front therebetween.

2. The mounting defined in claim 1, in which said backing plate is integrally formed with a plurality of rearwardly bent tabs for embedding in said layer of cement to prevent movement of the aligned backing plate during setting.

3. The mounting defined in claim 1, in which said front supporting means of the bracket includes a shoulder having adjustable means projecting therefrom for engaging a rear surface of the front to accommodate differences in thickness between adjacent fronts to insure vertical alignment of the forward facing surfaces of said fronts.

4. The mounting defined in claim 3, in which said adjustable means is a screw adjustably threaded into said shoulder.

5. The mounting defined in claim 3, in which said adjustable means is a compression spring mounted to compressibly project from a bore formed in said shoulder.

6. The mounting defined in claim 3, in which said front supporting means includes a plurality of shoulders, at least one shoulder being positioned behind a bottom corner of a front of an upper tier and having said adjustable means formed as a screw adjustably threaded into said shoulder, another shoulder being positioned behind an upper corner of an adjacent lower tier and having its adjustable means formed as a compression spring mounted to compressibly project from a bore formed in said other shoulder.

7. A method of installing aligned brackets for mounting a wall of individually removable fronts on a burial crypt structure having vertical and horizontal concrete paritions defining individual crypts arranged in horizontal rows and vertical tiers, the steps of aligning in a predetermined vertical plane backing plates having a centralized enlarged through-opening by applying each backing plate on a layer of cement to a partition intersection with said through-opening centralized with respect to the midline of said vertical partition, permitting the cement to set with said backing plates providing a mounting surface, locating a bracket having a plate-like base with a flat rear surface and an upper portion formed with spaced horizontally extending elongated slots on each mounting surface, drilling holes into the concrete of said vertical partition at points in said through-opening and in register with said elongated slots, and mounting the brackets to be flat against said backing plate mounting surface by anchor expansion bolts secured in said holes, said backing plate through-opening defining a limited medial area located to avoid cracking the concrete when the anchor bolts are expanded in said drilled holes.

8. The method defined in claim 7, in which said hole drilling is performed through said slots and through-opening while the bracket is retained in said located position on the backing plate.

* * * * *